US009764329B2

(12) United States Patent
Hoffmann

(10) Patent No.: US 9,764,329 B2
(45) Date of Patent: Sep. 19, 2017

(54) ROTARY MILL

(71) Applicant: Aaron Engineered Process Equipment, Inc., Bensenville, IL (US)

(72) Inventor: Jeffrey R. Hoffmann, Schaumburg, IL (US)

(73) Assignee: AARON ENGINEERED PROCESS EQUIPMENT, INC., Bensenville, IL (US)

( * ) Notice: Subject to any disclaimer, the term of this patent is extended or adjusted under 35 U.S.C. 154(b) by 337 days.

(21) Appl. No.: 13/741,975

(22) Filed: Jan. 15, 2013

(65) Prior Publication Data

US 2014/0197254 A1 Jul. 17, 2014

(51) Int. Cl.
*B02C 17/18* (2006.01)
*B02C 18/22* (2006.01)

(52) U.S. Cl.
CPC ..... *B02C 17/1865* (2013.01); *B02C 17/184* (2013.01); *B02C 17/1835* (2013.01); *B02C 18/2266* (2013.01)

(58) Field of Classification Search
CPC ... B02C 25/00; B02C 18/148; B02C 18/0084; B02C 17/14; B02C 17/16; B02C 17/10; B02C 17/18; B02C 15/08; B02C 1/04; B02C 2/04; B02C 4/28; B02C 17/1865; B02C 17/184; B02C 17/1835; B02C 18/2266; B01F 7/0025; E04F 21/085; B01J 2/12
USPC ..... 241/30, 60, 174, 176, 179, 180, 285.1, 241/285.2, 18, 170–173
See application file for complete search history.

(56) References Cited

U.S. PATENT DOCUMENTS 1,427,234 A * 8/1922 Sherban ..... 241/49
2,675,967 A * 4/1954 Mote ..... 241/47
4,288,166 A * 9/1981 Nakabayashi ..... C10L 1/322 241/15
4,382,557 A * 5/1983 Duerr ..... B02C 17/16 241/1
4,603,814 A * 8/1986 Mehltretter ..... B02C 17/183 241/171
4,673,134 A * 6/1987 Barthelmess ..... B02C 17/16 241/171
4,732,336 A * 3/1988 Eriksson ..... D21B 1/30 162/261
4,801,100 A 1/1989 Orlando
4,836,457 A * 6/1989 Greiner ..... 241/73
5,586,730 A * 12/1996 Mortrud ..... 241/24.22
5,630,558 A * 5/1997 Nitta ..... B02C 17/16 241/172
6,129,296 A * 10/2000 Campbell et al. ..... 241/30
(Continued)

*Primary Examiner* — Faye Francis
*Assistant Examiner* — Onekki Jolly
(74) *Attorney, Agent, or Firm* — Brinks Gilson & Lione

(57) ABSTRACT

A rotary milling system includes a rotatable cylinder, a discharge grate, a movable flap valve into and out of engagement with the grate, a discharge housing surrounding the grate, and a conveying pipe extending from the discharge housing. The cylinder can include grinding media for abrading a product when the cylinder is rotated. The product can be in either a dry form or within a liquid medium. Upon conclusion of the milling, the flap valve can be opened to allow the milled product to pass through the grate and into the discharge housing. A negative pressure can be applied to draw the milled product through the conveying pipe into a separator tank.

17 Claims, 7 Drawing Sheets

(56) References Cited

U.S. PATENT DOCUMENTS

| | | | | |
|---|---|---|---|---|
| 2010/0102151 | A1* | 4/2010 | Gerl | B02C 17/16<br>241/18 |
| 2010/0127108 | A1* | 5/2010 | Harbs | B02C 17/161<br>241/152.2 |
| 2011/0000993 | A1* | 1/2011 | Lang | B02C 17/16<br>241/171 |
| 2011/0146933 | A1* | 6/2011 | Page | B02C 17/1855<br>162/232 |

* cited by examiner

ROTARY MILL

BACKGROUND

The present invention relates to rotary mills. More particularly, the invention relates to an automated system for reliably discharging rotary mills.

Rotary mills, also known as ball mills, pebbles mills, rod mills, or tumble mills, are well known in the art. A traditional rotary mill includes a horizontal rotating cylinder that rotates about a central axis. The cylinder includes grinding media that is generally spherical, cylindrical, or another uniform shape. Solid target materials are placed, as a dry solid or along with a liquid medium, into the cylinder for milling. The cylinder is rotated, causing the grinding media to tumble along with the target material, with the grinding media abrading and impacting the target solids. Continued rotation of the cylinder results in a milled product in the form of dry fine particles or particles suspended in liquid media.

Upon completion of the milling process, the product is discharged from the cylinder. The cylinder includes an opening with a solid cover that can be manually removed and replaced with a discharge grate, which will retain the grinding media but allow the product to pass through.

In the case of dry product, the product can become trapped between grinding media when the cylinder is stationary. Thus, to discharge the product, the cylinder can be rotated with the discharge grate open to discharge the solid product. In the case of a wet product, the cylinder can remain stationary if the liquid suspending the product is low-viscosity to flow past the media due to gravity. In the case of non-Newtonian or high-viscosity liquids, the cylinder can be rotated to discharge the product, similar to dry product.

In another form, the grinding media and product can be dumped from the cylinder without the use of a grate, and subsequently separated by a grate, filter, or vibrating sifter.

The rotary mill also includes a discharge housing that surrounds the rotating cylinder to define an annular space between the cylinder and the housing. The housing also includes a collection hopper at the bottom. When the product is discharged, as described above, the product will enter the annular space and fall into the hopper.

However, the above discharge process can result in dirty conditions, with dust becoming adhered to the inner surface of the housing as well as the outside of the cylinder. Retrieval of the product from the discharge housing can also result in dust entered the surrounding air. These conditions can reduce the amount of product recovered, as well as lead to cross-contamination issues and cleaning problems. In the case of liquid product, the operator must make and break a piped connection to the discharge housing, exposing the milled product and solvent vapors to the surrounding area during this connection.

Accordingly, there is a need for a discharge system that can reliably deliver the milled product from the cylinder while limiting loss of product and exposure of the product to adjacent areas and operators.

SUMMARY

A rotary milling system is provided comprising: a rotatable cylinder defining a cavity and a central longitudinal axis; a discharge grate provided on a sidewall of the cylinder and defining an opening to allow milled product to pass therethrough; a discharge housing surrounding the discharge grate and defining a cavity therein; a flap disposed within the discharge housing and moveable between a closed position covering the opening of the discharge grate and an open position away from the opening; a conveying pipe in fluid communication with the housing; and a negative pressure producing vacuum member operatively associated with the conveying pipe to create a negative pressure within the conveying pipe.

In another form, the system further comprises a rotary union connected with the conveying pipe.

In another form, the system further comprises a secondary pipe connected to the rotary union, wherein the rotary union couples the secondary pipe and the conveying pipe and the secondary pipe is disposed between the negative pressure producing vacuum member and the conveying pipe.

In another form, the system further comprises a separator tank operatively coupled to the conveying pipe, wherein the vacuum member is in fluid communication with the separator tank.

In another form, the flap includes an elastomer face for creating a seal between the valve and the opening of the discharge grate when the flap is in the closed position.

In another form, the flap is pivotable relative to the discharge grate.

In another form, the system further comprises an actuator for moving the flap between an open and closed position.

In another form, the actuator is pneumatically operated.

In another form, the system further comprises a transmission portion coupled to the cylinder for rotating the cylinder.

In another form, the discharge housing includes a check valve for regulating the pressure in the system.

In another form, the system further comprises a dust filter located upstream of the vacuum member.

In another form, the system further comprises first and second trunion members for supporting the cylinder for rotation about the central axis.

In another form, the conveying pipe extends into and through the first trunion member.

In yet another form, a method for discharging milled product from a rotary mill is provided comprising: rotating a cylinder in which a plurality of grinding media and milled product are disposed; moving a flap away from a discharge grate provided on the cylinder, wherein the flap and discharge grate are surrounded by a discharge housing; discharging the milled product through the discharge grate into the discharge housing; and applying a negative pressure to a conveying pipe that is in fluid communication with the discharge housing to convey the product out of the housing and through the conveying pipe.

In another form, the method further comprises rotating the cylinder with the flap in an open position.

In another form, the method further comprises opening a check valve in the housing to provide sufficient airflow through the conveying pipe.

In another form, the milled product is disposed within a liquid medium.

DETAILED DESCRIPTION

Figure 1:
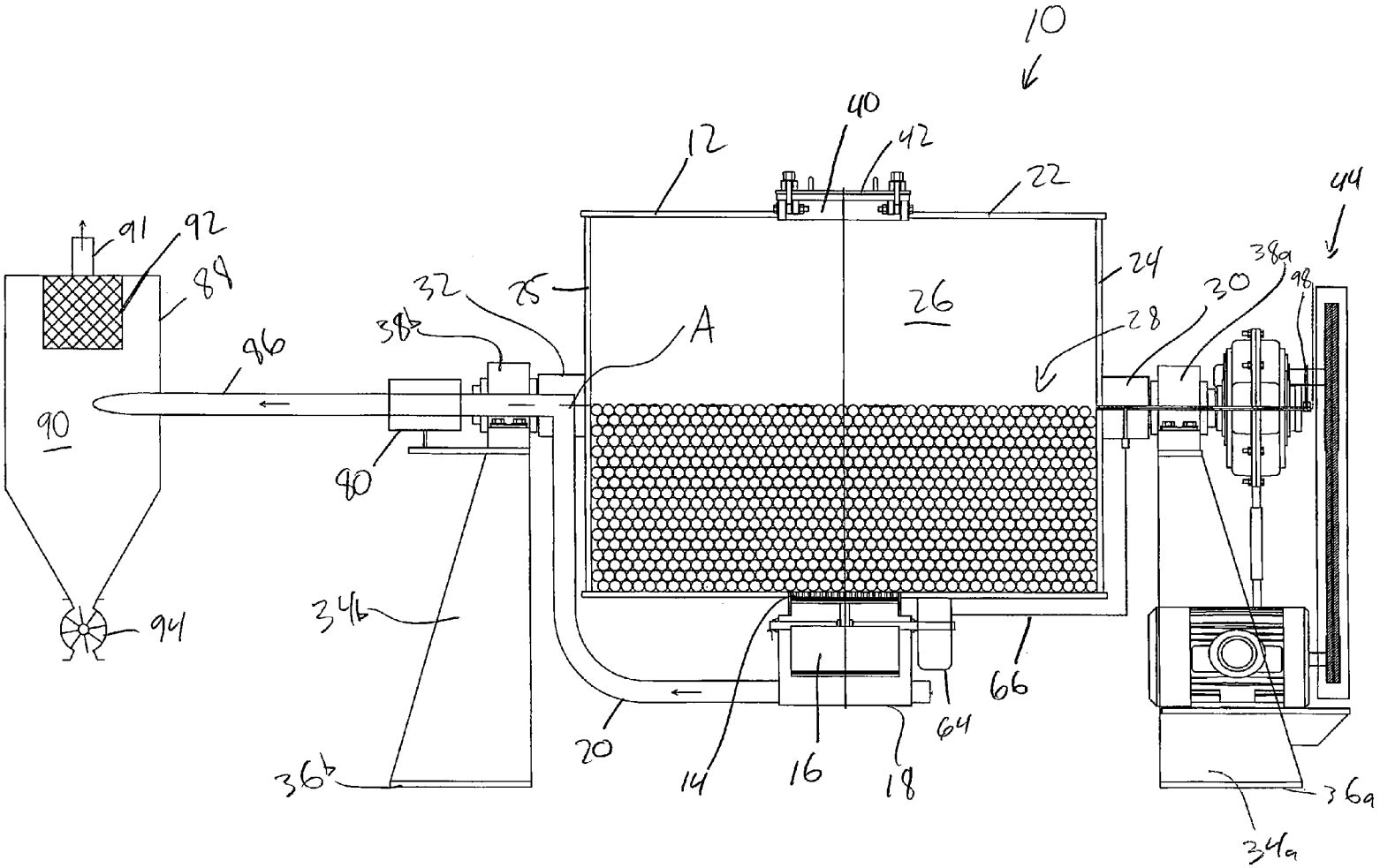
FIG. 1 is a front partial sectional view of a rotary milling system.

Referring now to the drawings, FIGS. 1-7B illustrate a rotary mill system 10 for milling a desired product. The system 10 includes a rotatable cylinder 12, a discharge grate 14 in the side of the rotatable cylinder 12, a pivotable flap 16 for covering the discharge grate 14, a dust-tight housing 18 mounted to the cylinder 12 and surrounding the grate 14, and a conveying pipe 20 in fluid communication with the housing 18 for discharging milled product from the cylinder 12.

With further reference to FIG. 1, the cylinder 12 includes a generally cylindrical sidewall 22 extending between a first end wall 24 and a second end wall 25. The sidewall 22 and end walls 24 and 25 define a cavity 26 having a longitudinal central axis A. The cylinder generally includes grinding media 28 disposed within the cavity 26 for performing a traditional rotary milling operation. The amount of grinding media 28 depends on the needs of the user. For example, the cavity 26 could be approximately 50% full of grinding media 28 by volume. Of course, other amounts, such as 30-60%, could also be used.

The grinding media 28 may be any suitably hard material, such as carbon steel, stainless steel, tungsten carbide, alumina, zirconia, porcelain, or the like. The grinding media can have different sizing as necessary. For example, in one form, the grinding media can be between ¼ inches in diameter to 1 inch in diameter. Of course, it could also be as small ⅛ inch or as large as 3 inches in diameter. The grinding media 28 is preferably a uniform size; however, the media size used in a particular operation could be different, where some of the media could be, for example, 1 inch in diameter with others being 2 inches in diameter. These sizes are merely exemplary and it will be appreciated that various other sizes of the grinding media could also be used.

The cylinder 12 also includes a first trunion 30 and a second trunion 32 extending outwardly from the end walls 24 and 25, respectively, along the central axis A. The trunions 30 and 32 support the cylinder 12 for rotating. More specifically, the system 10 includes a pair of vertical support members 34*a*, 34*b* each having a base 36*a*, 36*b* for contacting a support surface such as a floor and a bearing 38*a*, 38*b* for engaging and supporting the trunions 30 and 32 for rotation therein.

The cylinder 12 further includes a loading opening 40 extending through the sidewall 22 for delivering grinding media 28 or the product to be milled. An access hatch or loading cover 42 can be mounted over the opening 40 for sealing the opening 40 in a manner known in the art. The loading opening 40 can be diametrically opposed from the discharge grate 14 on the opposite side of the cylinder 12. However, other locations of the loading opening 40 in the sidewall 22 could also be used.

Figure 2B:
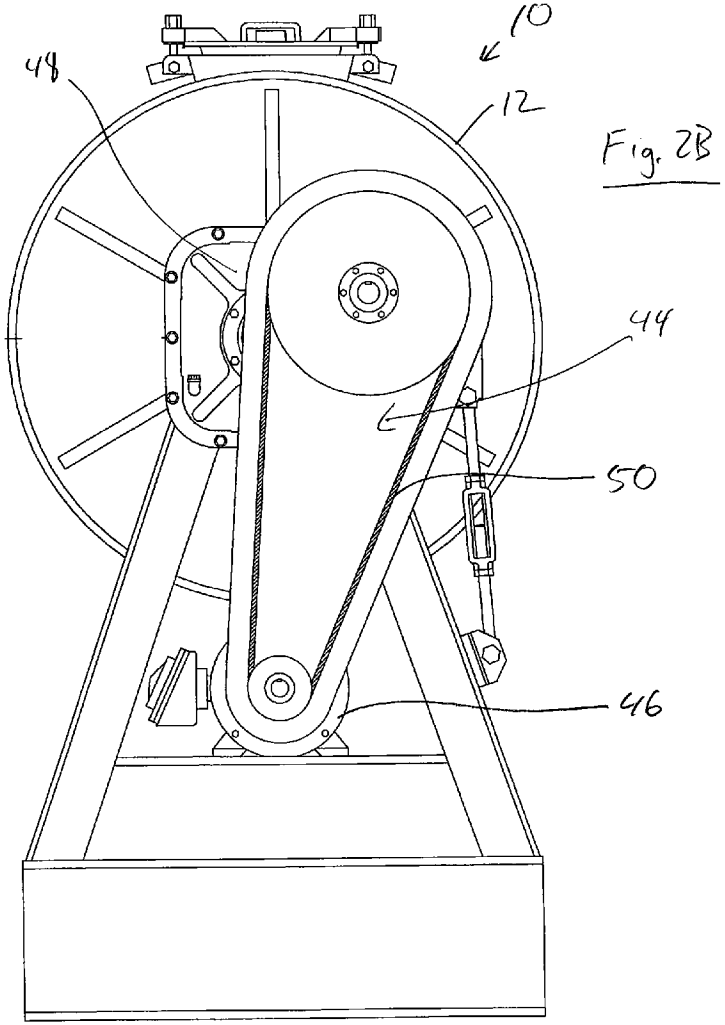
FIG. 2B is a side view of the transmission portion of the rotary milling system.
Figure 2A:
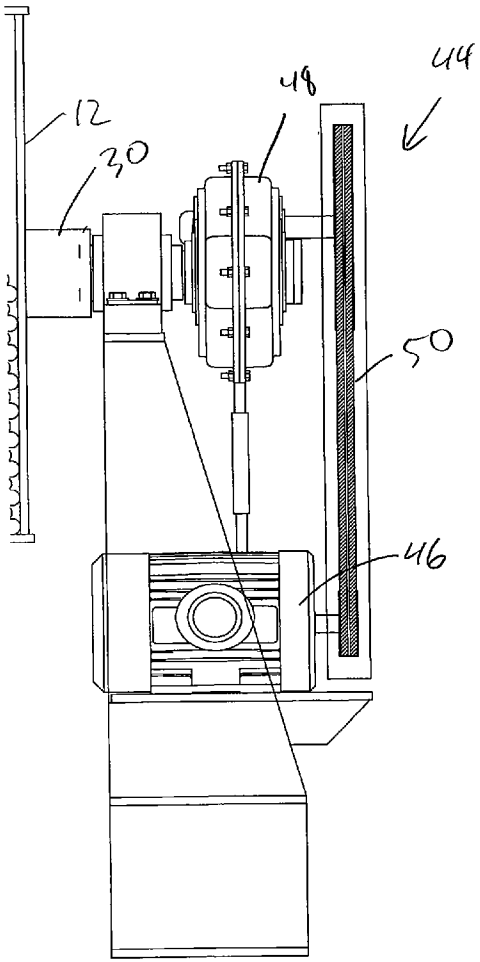
FIG. 2A is a front view of a transmission portion of the rotary milling system.

Turning to FIGS. 2A and 2B, the system 10 includes a transmission portion 44, including a motor 46, gear reducer 48, and belt 50. The gear reducer 48 is operatively coupled to the first trunion 30. The transmission portion 44 can generally operate and be controlled in a manner known in the art to rotationally drive the cylinder 12 through the connection between the gear reducer 48 and the first trunion 30.

Referring back to FIG. 1, the discharge grate 14 is provided on the sidewall 22 of the cylinder 12. The discharge grate 14 is configured with openings 52 that are sized to retain the grinding media 28 within the cavity 26, while allowing the milled product to pass through the openings 52. In one form, the openings 52 can be in the form of slots approximately 0.25 inches wide. However, it will be appreciated that other opening sizes could be used to retain the grinding media 28 while allowing the product to pass.

Figure 3:
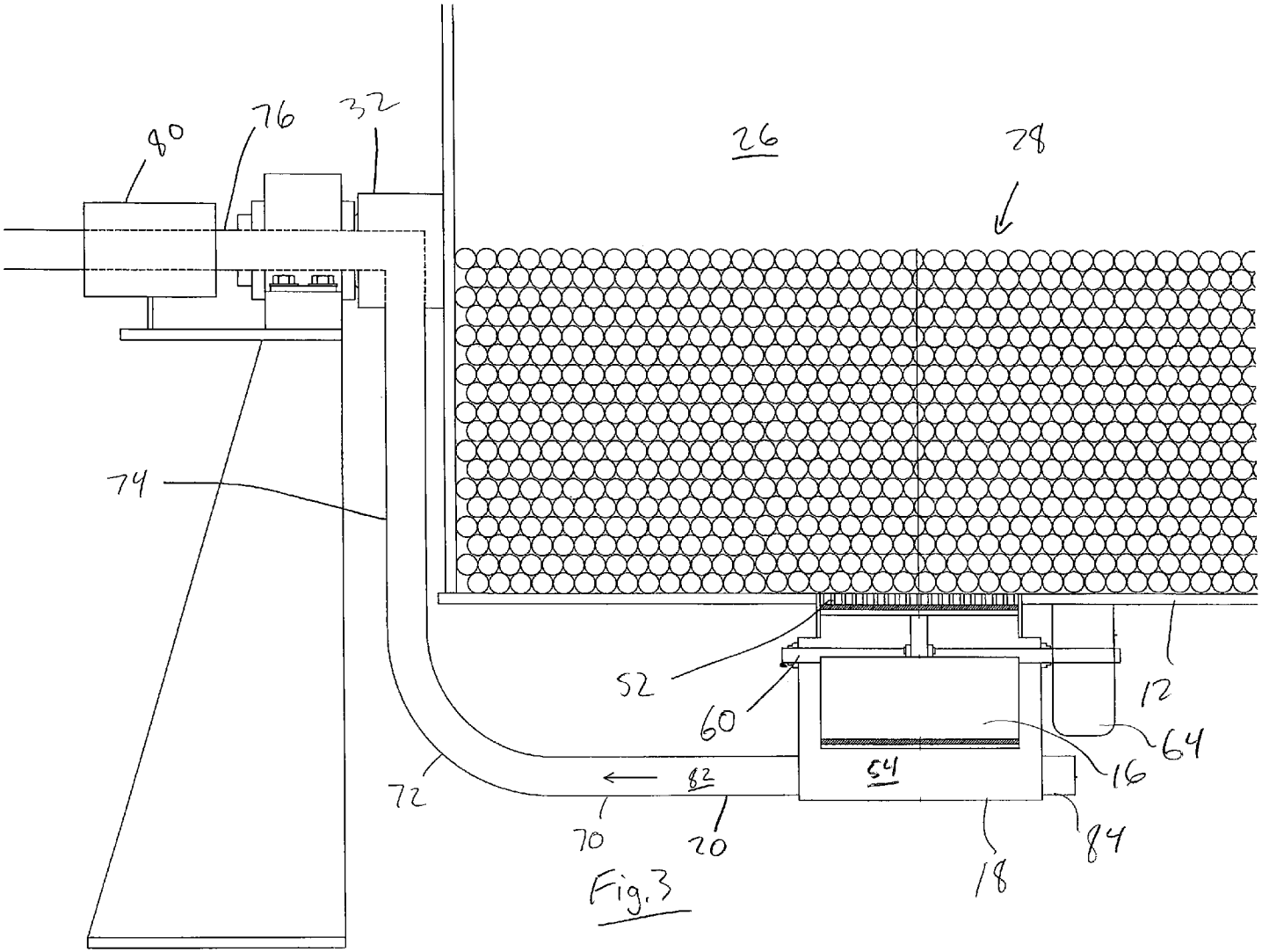
FIG. 3 is a front partial sectional view of a discharge grate, discharge housing, and conveying pipe of the rotary milling system.
Figure 4:
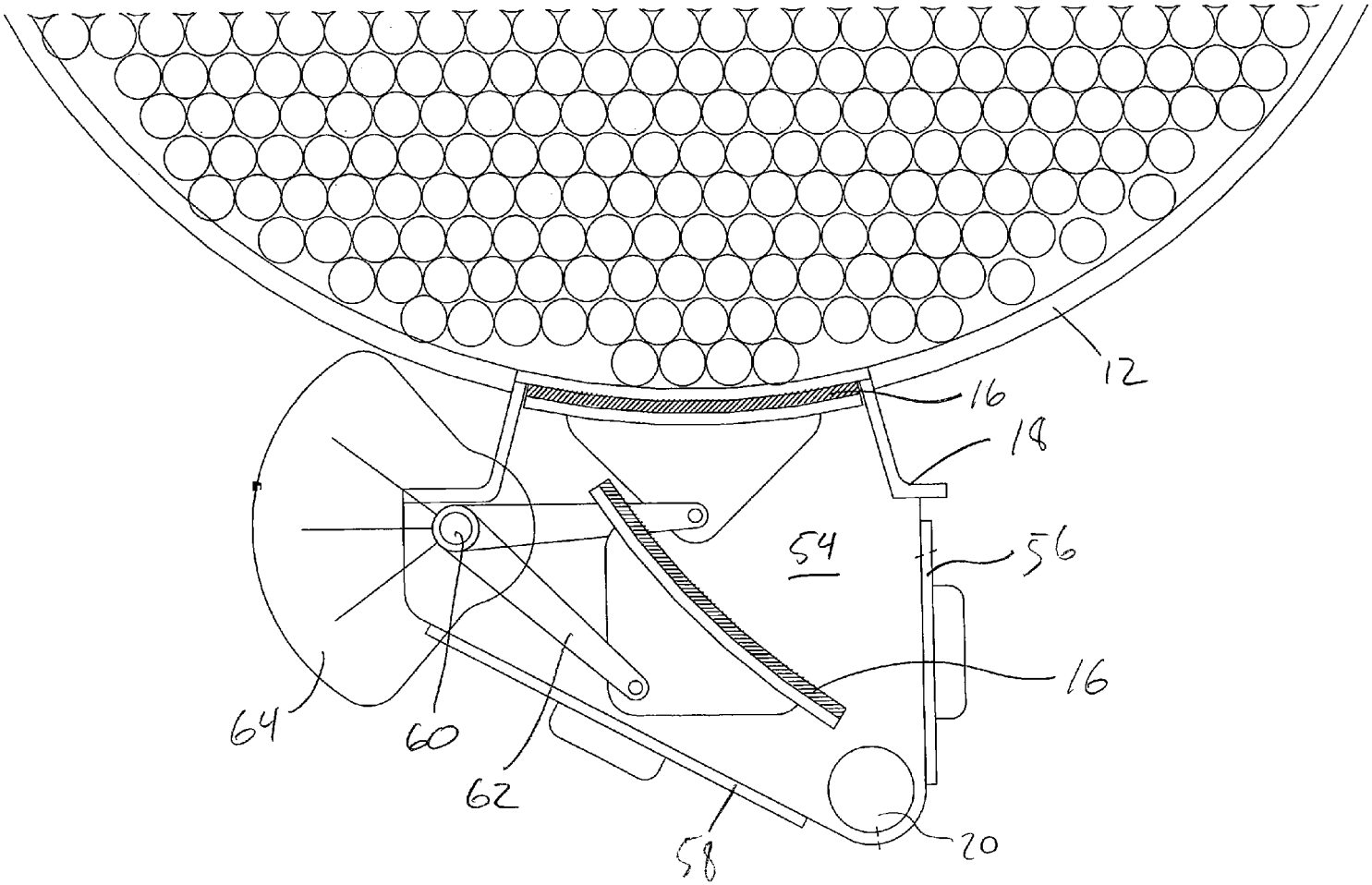
FIG. 4 is a cross-sectional side view of the discharge housing and an associated flap valve.
Figure 5:
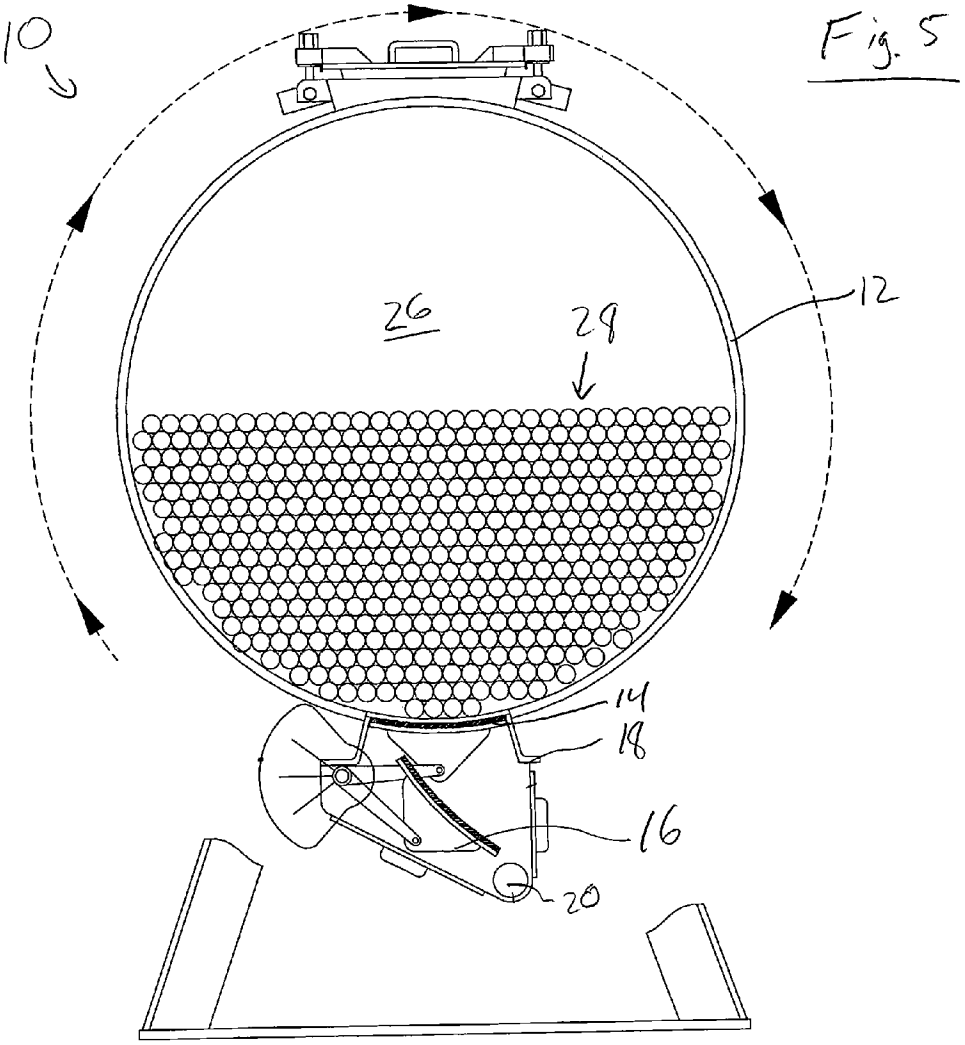
FIG. 5 is a cross-sectional side view of a rotatable cylinder and the discharge housing of the rotary milling system.

With reference to FIGS. 3-5, the housing 18 surrounds the discharge grate 14 to create a dust tight seal between the housing 18 and the cylinder 12. Accordingly, the housing 18 may be attached to the sidewall 22 of the cylinder 12. The dust tight seal between the housing 18 and the cylinder 12 helps to limit milled product from escaping to the adjacent air supply or onto the outer surface of the cylinder 12 outside the housing 18. Thus, the cylinder 12 and the surrounding environment may be kept cleaner relative to a housing surrounding the entire cylinder 12. A cavity 54 is defined by the space between the housing 18 and the cylinder 12 into which milled product can be temporarily stored after passing through the openings 52 in the grate 14.

The housing 18 can further include first and second access hatches 56 and 58 that can provide access into the housing cavity 54, if necessary. The access hatches 56 and 58 can be gasketed and bolted in a manner known in the art to provide a dust-tight seal between the housing cavity 54 and the air surrounding the housing 18.

With reference to FIG. 4, the flap 16 is disposed within the housing cavity 54 and is sized to correspond to the size of the discharge grate 14. The flap 16 is pivotable into and out of contact with the discharge grate 14 to prevent and allow discharge of product through grate 14, respectively. FIG. 4 shows the flap 16 in both the open and closed positions. The flap 16 can have a generally curved profile to correspond to the curved shape of the cylinder 12, and can be pivotable about an axle 60 via a linkage 62. The flap 16 can have an elastomer face or other material that can provide a seal between the grate 14 and the flap 16 when the flap 16 is in the closed position.

An actuator 64 can be connected to the axle 60 outside of the housing 12 to rotate the axle 60 and thus, pivot the flap 16. The actuator 64 can be manually operated to open and close the flap 16 or it could be automatically operated. In the case of manual operation, an operator can be positioned adjacent the housing 18 with limited interaction with the dust produced by the milled solid. In the case of automated operation, the operator can be positioned remotely to open and the close the flap 16 likewise limiting interaction with the milled product. In one form, the actuator 64 can be in the form of a vane actuator, as shown in FIG. 4.

An automated actuator 64 can be pneumatically activated in a manner known in the art. The pneumatic pressure can be provided by a supply line 66 (shown in FIG. 1) extending radially from the first trunion 30, as well as longitudinally through the first trunion 30 to an air supply source (not shown).

With reference to FIGS. 1 and 3, the milled product can be delivered from the housing 18 via the conveying pipe 20.

The conveying pipe 20 is in fluid communication with the housing 18. For example, the conveying pipe 20 can be mounted or connected to the housing 18 away from the discharge grate 14 and the cylinder 12. The conveying pipe 20 has a generally circular cross-section and includes a longitudinal portion 70 extending generally parallel to the central axis A of the cylinder 12. The conveying pipe 20 further includes a curved elbow portion 72 extending from the longitudinal portion 70 and transitioning into a radial portion 74, which extends toward the central axis of the cylinder 12. The radial portion 74 is coupled with the second trunion 32 at a point generally along the central axis A of the cylinder 12. The radial portion 74 of the pipe 20 transitions into an axial portion 76 that extends along the central axis A of the cylinder 12 and into a rotary union 80. As a whole, the pipe 20 defines a passageway 82 having a central axis and extending through the pipe 20. The passageway 82 is in fluid communication with the housing cavity 54, so that milled product can be conveyed from the housing 18 through the pipe 20.

The housing 18 can include a check valve 84 mounted to the side of the housing 18 generally opposite the interface between the housing 18 and the pipe 20. The check valve 84 can be in the form of a poppet valve, and can operate as a vacuum breaker or to allow air into the cavity 54 to provide for sufficient conveying velocity of the milled product out of the housing 18 through the pipe 20. The check valve 84 can be configured and sized to allow for different desired air pressure within the cavity 54 in a manner known in the art.

With reference again to FIGS. 1 and 6, the system 10 further includes a secondary pipe 86 extending axially from the rotary union 80 and into a separator tank 88. The secondary pipe 86 is fluidly coupled to the axial portion 76 of the conveying pipe 20 via the rotary union 80 in a manner known in the art. The separator tank 88 defines a cavity 90 for receiving milled product that has been conveyed form the conveying pipe 20 and through the secondary pipe 86. The separator tank 88 can be connected to a blower or vacuum 91. FIG. 1 illustrates that the blower or vacuum 91 is connected at the top of the tank 88. The blower or vacuum 91 can provide a negative pressure to the tank 88 as well as the secondary pipe 86 and conveying pipe 20 for drawing the milled product toward the tank 88.

The tank 88 can include different components depending on whether the milled product is a solid discharge, such as dry fine particles, or liquid discharge, where the particles are suspended in the liquid.

With reference to FIG. 1, in the case of solid discharge, the separator tank 88 can include a dust filter 92 mounted within the cavity 90 and surrounding the blower 91. The dust filter 92 can allow airflow through the filter 92 while limiting the solid discharge from being sucked into the vacuum 91. An opening can be provided at the bottom of the tank for retrieving the milled material. A valve, such as a rotary valve or slide gate valve 94 can be associated with the opening.

Figure 6:
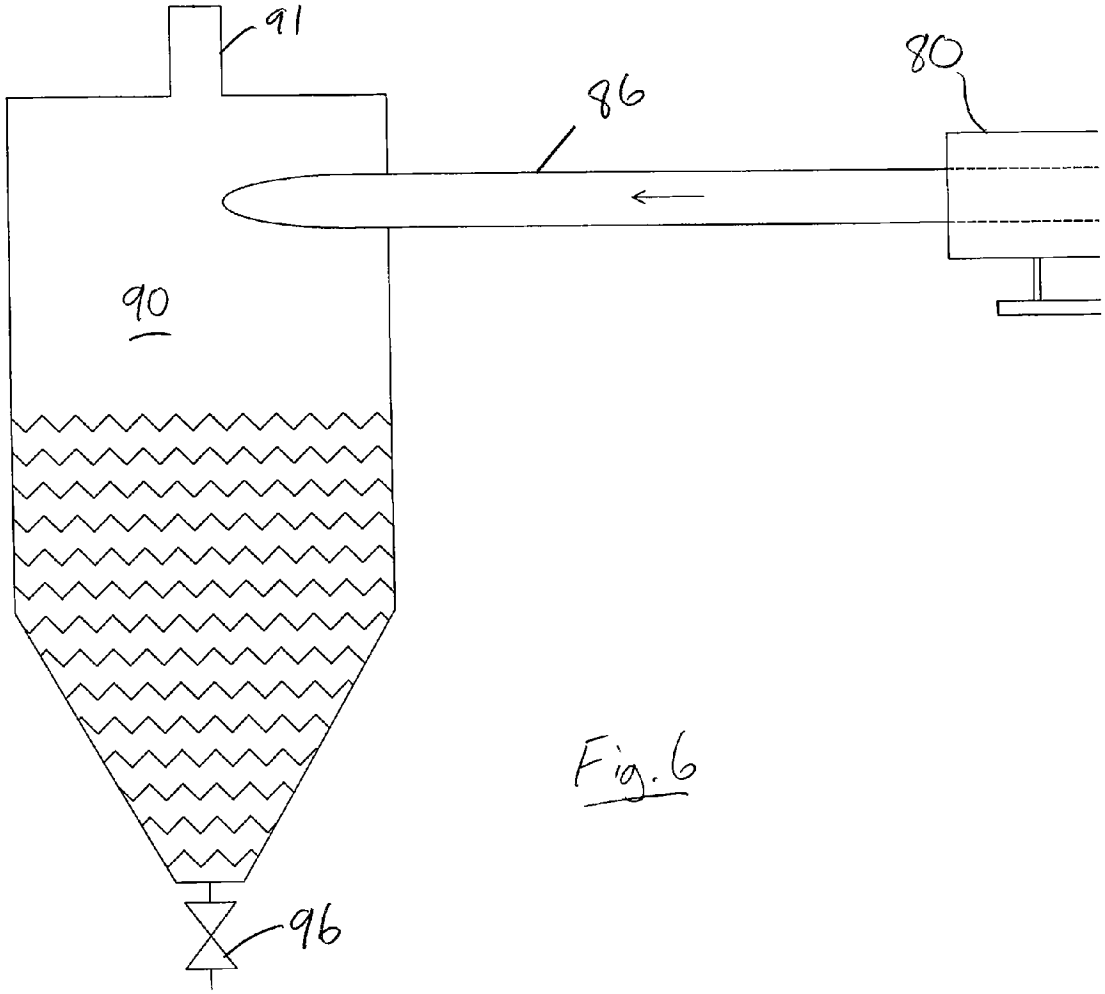
FIG. 6 is a front view of a separator tank of the rotary milling system.

With reference to FIG. 6, in the case of liquid discharge, the tank 88 can include a valve 96 mounted to the bottom of the tank 88. The separator tank 88 can be a cyclone separator, which can separate the milled product from the liquid. The milled product can be vacuumed out of the tank 88 through the blower or vacuum 91 mounted at the top of the tank 88, and the valve 96 can release the liquid from the tank 88.

As shown in FIG. 1, the cylinder 12, trunions 30 and 32, bearings 38, secondary pipe 86, rotary union 80, and the axial portion 76 of the conveying pipe 20 can be coaxially aligned along the central axis A of the cylinder 12. As the cylinder 12 rotates about its central axis A via the trunions 30 and 32 and bearings 38*a*, 38*b*, the coaxially aligned components, not including the secondary pipe 86 and rotary union 80, will rotate as well. The housing 18, mounted to the cylinder 12, will rotate along with the cylinder 12. The remaining portions of the conveying pipe 20 will rotate with the cylinder 12 and remain connected to the housing 18. The housing 18 and tank 88 can remain fluidly connected through the pipes 20 and 86 while rotating. Thus, the milled product can be delivered to the tank 88 if the cylinder 12 is either rotating or stationary.

Having described the general structure of the system 10, the function of the rotary milling system 10 described above will now be described in further detail.

With the cylinder 12 in a stationary position and the flap 16 in the closed position over the grate 14, the loading cover 42 can be opened to allow access into the cavity 26 of the cylinder 12. The desired product to be milled can be deposited into the cavity 26 for subsequent milling by the system 10. This process can be performed for both dry milling and liquid milling. Additionally, grinding media 28 can be deposited into the cavity 26 or removed from the cavity 26 depending on the needs of the user.

Once the desired amount of product and grinding media 28 are present in the cavity 26 of the cylinder 12, the loading cover 42 can be replaced on the cylinder 12 to create a seal and limit milled product from exiting the cavity 26 during the milling process. Similarly, the flap 16 is in the closed position over the discharge grate 14 in a sealed configuration to likewise limit milled product from exiting the cavity during the milling process.

Figure 7B:
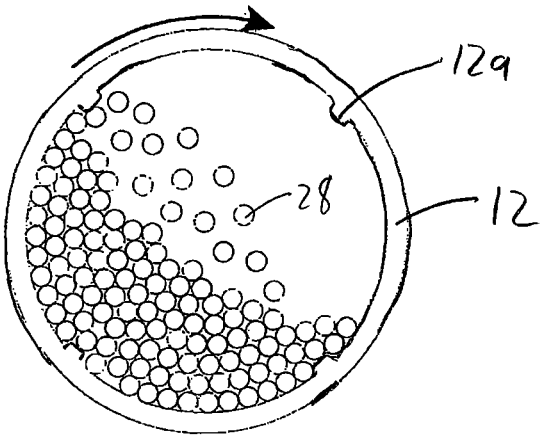
FIG. 7B is a cross-sectional view of the rotatable cylinder showing the cylinder in a rotating configuration and cataracting grinding media therein.
Figure 7A:
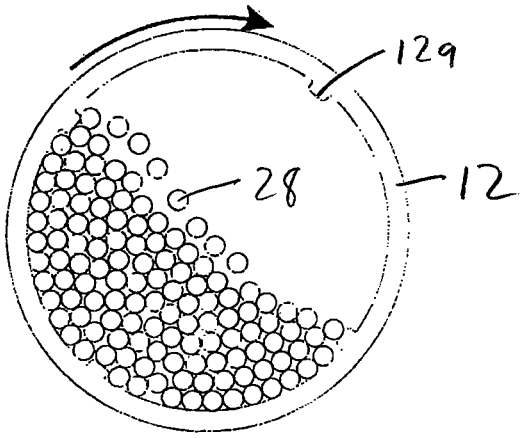
FIG. 7A is a cross-sectional view of the rotatable cylinder showing the cylinder in a rotating configuration and tumbling grinding media therein.

With reference to FIGS. 7A and 7B, with the product ready for milling, the cylinder 12 can be controllably rotated by the transmission portion 44 of the system 10 in a manner known in the art. The cylinder 12 will rotate about its central axis A via the interface between the trunions 30 and 32 and the bearings 38. As the cylinder 12 rotates, the grinding media 28 is lifted and then tumbles back down to the bottom of the cylinder 12. This tumbling causes the grinding media 28 to abrade and impact the solid product. There are two types of action for the grinding media depending on the speed of rotation of the cylinder 12. "Tumbling" occurs are lower rotational speeds, with the grinding media 28 rolling or tumbling across the build-up of media 28 in the lower portion of the cylinder 12 and is illustrated in FIG. 7A. "Cataracting" occurs at higher rotational speeds, where the media 28 free-falls from the top of the cylinder 12 to the mass of media 28 at the bottom of the cylinder and is illustrated in FIG. 7B.

To assist in lifting the grinding media during operation, the cylinder 12 can include a plurality of longitudinally running ribs 12*a* within the cavity 26 of the cylinder 12. These ribs 12*a* can be seen in FIGS. 7A and 7B.

As stated above, the solid product to be milled can be processed in a dry milling operation or a wet milling operation. In the dry milling operation, the solids are milled in a dry state and subsequently discharged dry. In the wet milling operations, the solids are milled in a liquid medium and the milled product is discharged as a liquid suspension or dispersion. Both processes are performed in the same general manner described above, with the cylinder 12 rotating at a selected speed to cause the grinding media 28 to be lifted and then fall or tumble to abrade the product.

During the rotation of the cylinder 12, the housing 18 and conveying pipe 20 will rotate about the central axis of the cylinder 12. Because the conveying pipe 20 extends to couple with the trunion 32 and into the rotary union 80, the pipe 20 remains in fluid communication with the housing 18 mounted to the cylinder 12 and the secondary pipe 86 leading to the separator tank 88.

At the conclusion of the rotation of the cylinder 12 during the milling process, the cylinder 12 will contain the product as either a dry solid in a fine particle form, or as a wet solid in a liquid medium. Depending on the type of milling operation (dry or wet), the product may require additional rotation of the cylinder 12.

In the case of dry milling, the product may become trapped between individual members of the grinding media 28. The cylinder 12 can be further rotated to loosen and free the product from the grinding media 28, if necessary.

In the case of liquid milling, if the liquid has a low viscosity, the liquid medium and the solid product contained in the liquid can generally flow through the grinding media 28 toward the bottom of the cylinder 12 without requiring additional rotation. If the liquid is non-Newtonian or has a high viscosity, the cylinder 12 may require additional rotation, similar to dry milling.

If the particular milling process used does not generally require additional rotation of the cylinder 12 to discharge the product, the cylinder 12 can be rotatably positioned such that the discharge grate 14 is at the bottom of the cylinder 12. The flap 16 can be opened via the actuator 64 allowing the product to flow through the grate 14 and into the cavity 54 of the housing 18. The actuator 64 can be operated automatically or manually. In either case, the product can pass through the grate 14 without exposing the operator or the surrounding environment to the milled product or solvent vapors. Rather, the product remains substantially contained within the housing 18.

If the cylinder 12 is required to rotate to discharge the milled product, for reasons described above, the flap 16 can remain in the open position allowing the milled product to pass through the grate 14. The milled product will remain contained within the system 10 during this rotation. As described above, the flap 16 can be automatically opened via a pneumatic connection. The air delivery line 66 to produce the pneumatic connection will rotate along with the cylinder 12 during the rotation.

While the milled product is being discharged through the grate 14 and into the cavity 54 of the housing 18, the conveying pipe 20 can convey the milled product to the separator tank 88. More specifically, a vacuum or negative pressure can be applied to the conveying pipe 20 from the blower or vacuum 91 mounted to the tank 88. The vacuum will be applied through the secondary pipe 86, the rotary union 80, and the conveying pipe 20 to pull the milled product from the housing cavity 54. This vacuuming of the milled product from the housing 18 allows for the housing 18 to be substantially smaller than the total volume of product that is discharged.

In the case of dry solids, the vacuum is used to create an air stream where the solids are suspended in the air stream. In the case of liquid discharge, a slight vacuum is drawn to motivate fluid flow.

The vacuum applied through the conveying pipe 20 can occur with the cylinder 12 and housing 18 either stationary or rotating. Because the conveying pipe 20 and housing 18 rotate along with the cylinder 12, and the conveying pipe 20 is coupled to the rotary union 80, the negative pressure to retrieve the discharging product is not dependent on the cylinder 12 rotating or remaining stationary.

In the event the pressure in the housing cavity 54 or conveying pipe 20 is ineffective to retrieve the milled product, the check valve 84 can open to regulate the pressure in the system 10. In the case of dry discharge, the check valve 84 is in the form of a poppet that will allow sufficient air flow to maintain sufficient velocity to keep the solids suspended in the air stream created by the vacuum. An air bleed 98 can be provided on the opposite trunion to allow air or for gas purging. In the case of liquid discharge, the check valve 84 is in the form of a vacuum breaker.

The use of a vacuum or negative pressure on the system 10, in addition to retrieving the product during the discharging process, can also be used to clean the system. The conveying pipe 20 and secondary pipe 86 can have a generally circular cross-section to limit the amount of build-up of product between the cylinder 12 and the tank 88.

Moreover, the use of negative pressure or a vacuum through the system 10 also limits instances of product escaping past a seal and into the surrounding area or into contact with an operator. Rather, the negative pressure will continue to pull product back into the system 10 in the event of a leak in one of the seals, in contrast to a system that forces air through a passageway that would push product out of a leaking seal or joint and into the surrounding area.

Additionally, to prevent build-up of product within the conveying pipe 20, rotary union 80, and secondary pipe 86, these components can be made from tri-clamp sanitary connections that retain little product, and can be broken down and easily cleaned.

The use of negative pressure to pull the product toward the separator tank 88 also allows the system 10 to be generally free from other conveying mechanisms, such as augers or the like, that can become easily contaminated and dirty after repeated use.

At the conclusion of the retrieval process, the flap 16 can be closed, manually or automatically, to allow for another milling operation. The milled product can be retrieved from the separator tank 88 in a manner known in the art.

As a person skilled in the art will readily appreciate, the above description is meant as an illustration of implementation of the principles this invention. This description is not intended to limit the scope or application of this invention in that the invention is susceptible to modification, variation, and change, without departing from the spirit of this invention, as defined in the following claims.

What is claimed is:

1. A rotary milling system comprising:

a rotatable cylinder defining a cavity and a central longitudinal axis, the cylinder having a first end wall and a second end wall and a sidewall extending therebetween;

a discharge grate provided on the sidewall of the cylinder and defining an opening to allow milled product to pass therethrough;

a discharge housing attached to an exterior of the cylinder and disposed outside of the cavity, the discharge housing surrounding the discharge grate and defining a cavity therein;

a flap disposed within the discharge housing and moveable between a closed position covering the opening of the discharge grate and an open position away from the opening;

a conveying pipe having a first end attached to the discharge housing and a second end and a passageway extending between the first and second ends through which milled product is conveyed, wherein the passageway is entirely disposed outside of the cavity of the cylinder, the passageway being in fluid communication with the discharge housing through the first end of the conveying pipe;

wherein the conveying pipe includes a laterally outward portion where a central axis of the passageway is laterally displaced from the central longitudinal axis of the cylinder; and a negative pressure producing vacuum member operatively associated with the conveying pipe to create a negative pressure within the conveying pipe, wherein the vacuum member is in fluid communication with the passageway of the conveying pipe through the second end of the conveying pipe;

wherein the discharge housing includes an air inlet separate from the discharge grate, the air inlet located downstream from the opening of the discharge grate relative to the cavity of the cylinder;

wherein the air inlet is configured to allow sufficient air flow to maintain sufficient velocity to keep solids suspended in an airstream created by the vacuum member such that air can flow through the discharge housing without flowing through the cylinder thereby providing airflow through the conveying pipe;

wherein a path of the airstream created by the vacuum member for conveying the milled product begins at the air inlet of the discharge housing and flows through the discharge housing outside of the cavity of the cylinder and into the first end of the conveying pipe, through the passageway, and out of the second end of the conveying pipe, such that milled product passing through the discharge grate from the cavity will enter the airstream after passing into the cavity of the discharge housing and will be conveyed to the second end of the conveying pipe;

wherein the discharge housing, conveying pipe, and vacuum member are in fluid communication throughout an entire rotation of the rotatable cylinder such that the airstream will be maintained from the cavity of the housing, through the first end of the conveying pipe, through the passageway, through the second end of the conveying pipe, and to the vacuum member during rotation of the cylinder independent of the rotational position of the cylinder and the conveying pipe;

wherein the airstream produced by the vacuum member will flow through the passageway in an uninterrupted manner throughout an entire rotation of the cylinder.

2. The system of claim 1 further comprising a rotary union connected with the conveying pipe.

3. The system of claim 2 further comprising a secondary pipe connected to the rotary union, wherein the rotary union couples the secondary pipe and the conveying pipe and the secondary pipe is disposed between the negative pressure producing vacuum member and the conveying pipe.

4. The system of claim 1 further comprising a separator tank operatively coupled to the conveying pipe, wherein the vacuum member is in fluid communication with the separator tank.

5. The system of claim 1, wherein the flap includes an elastomer face for creating a seal between the flap and the opening of the discharge grate when the flap is in the closed position.

6. The system of claim 1, wherein the flap is pivotable relative to the discharge grate.

7. The system of claim 1 further comprising an actuator for moving the flap between an open and closed position.

8. The system of claim 7, wherein the actuator is pneumatically operated.

9. The system of claim 1 further comprising a transmission portion coupled to the cylinder for rotating the cylinder.

10. The system of claim 1 wherein the air inlet comprises a check valve for regulating the pressure in the system and allowing air to flow into the discharge housing in response to suction applied to the discharge housing via the conveying pipe.

11. The system of claim 4, further comprising a dust filter located upstream of the vacuum member.

12. The system of claim 1, further comprising first and second trunnion members for supporting the cylinder for rotation about the central axis.

13. The system of claim 12, wherein the conveying pipe extends into and through the first trunnion member.

14. A method for discharging milled product from a rotary mill comprising:

rotating a cylinder in which a plurality of grinding media and milled product are disposed, wherein the cylinder includes a first end wall and a second end wall and a sidewall extending therebetween, and the cylinder defines a central longitudinal axis about which the cylinder rotates;

moving a flap away from a discharge grate provided on the sidewall of the cylinder, wherein the flap and discharge grate are surrounded by a discharge housing attached to an exterior surface of the sidewall and defining a discharge cavity therein;

discharging and passing the milled product from the cavity of the cylinder through the discharge grate and into the discharge housing; and applying a negative pressure to a conveying pipe that is in fluid communication with the discharge housing to convey the product out of the housing and through the conveying pipe, wherein the conveying pipe has a first end attached to the discharge housing and a second end and a passageway extending between the first and second ends, wherein the passageway is entirely disposed outside of the cylinder, wherein the conveying pipe includes a laterally outward portion where a central axis of the passageway is laterally displaced from the central longitudinal axis of the cylinder;

wherein air for conveying the product through the conveying pipe is provided through an air inlet disposed on the discharge housing, the air inlet being separate from the discharge grate and located downstream from the discharge grate relative to the cavity of the cylinder, the air inlet configured to allow sufficient air flow to maintain sufficient velocity to keep solids suspended in an airstream created by the vacuum member such that air can flow through the discharge housing without flowing through the cylinder thereby providing airflow through the conveying pipe;

creating the airstream beginning at the air inlet disposed on the discharge housing, wherein the airstream has a path extending from the air inlet, though the discharge housing, and into the passageway of the conveying pipe, wherein the milled product enters the airstream after passing through the discharge grate into the housing;

wherein the discharge housing, conveying pipe, and vacuum member are in fluid communication throughout an entire rotation of the rotatable cylinder such that the airstream is maintained during rotation of the cylinder independent of a location of the laterally outward portion of the conveying pipe during rotation.

15. The method of claim 14 further comprising rotating the cylinder with the flap in an open position.

16. The method of claim 14, wherein the air inlet comprises a check valve, the method further comprising opening the check valve in the discharge housing to allow air into the discharge housing and to provide sufficient airflow through the conveying pipe.

17. The method of claim 14 wherein the milled product is disposed within a liquid medium.

* * * * *